US009861144B2

(12) United States Patent
Carver

(10) Patent No.: US 9,861,144 B2
(45) Date of Patent: Jan. 9, 2018

(54) PANTLEG HOLDING MECHANISM FOR KNEE PADS

(71) Applicant: 5 Seas Engineering & Trading LLC, Dittmer, MO (US)

(72) Inventor: John W. Carver, Dittmer, MO (US)

(73) Assignee: 5 Seas Engineering & Trading LLC, Dittmer, MO (US)

( * ) Notice: Subject to any disclaimer, the term of this patent is extended or adjusted under 35 U.S.C. 154(b) by 0 days.

(21) Appl. No.: 14/932,340

(22) Filed: Nov. 4, 2015

(65) Prior Publication Data

US 2016/0050988 A1 Feb. 25, 2016

Related U.S. Application Data

(63) Continuation-in-part of application No. 13/781,333, filed on Feb. 28, 2013, now Pat. No. 9,655,391.

(51) Int. Cl.
*A41D 13/05* (2006.01)
*A41D 13/06* (2006.01)

(52) U.S. Cl.
CPC ..... *A41D 13/0575* (2013.01); *A41D 13/0568* (2013.01); *A41D 13/065* (2013.01)

(58) Field of Classification Search
CPC ..... A41D 13/0575; A41D 13/0568; A41D 13/0543; A41D 13/055; A41D 13/0556; A41D 13/0562
USPC ..... 2/24, 23, 22
See application file for complete search history.

(56) References Cited

U.S. PATENT DOCUMENTS 891,533 A 6/1908 Gibbs
1,225,799 A * 5/1917 Goldsmith ..... A41D 13/065 2/22
1,446,251 A * 2/1923 Goldsmith ..... A41D 1/08 2/228
1,636,553 A * 7/1927 Cruden ..... A41D 1/08 2/23
1,669,085 A * 5/1928 Guyon ..... A41D 1/08 2/23
2,561,872 A 7/1951 Krinick
2,568,083 A 9/1951 Mitchell
3,346,877 A * 10/1967 Zirves ..... A41D 13/0568 2/24

(Continued)

FOREIGN PATENT DOCUMENTS

EP 0697178 A2 2/1996
FR 2870432 A1 11/2005

OTHER PUBLICATIONS

European Search Report dated Sep. 15, 2015.

*Primary Examiner* — Alissa L Hoey
(74) *Attorney, Agent, or Firm* — Husch Blackwell LLP

(57) ABSTRACT

A knee pad holding mechanism for holding a knee pad over the knee region of a pantleg having a first length of fabric material and a second length of fabric material operatively attached to a pantleg on opposite sides of the knee region, each length of material forming a plurality of loops for receiving a strap associated with the knee pad. The plurality of loops associated with the first and second lengths of material are arranged in opposed relationship to each other and allow a user greater flexibility to adjust the vertical location of a knee pad relative to the user's knee. The plurality of loops can be individually formed on opposite sides of the knee region, or they can be formed using any number of a plurality of sections.

1 Claim, 5 Drawing Sheets

(56) References Cited

U.S. PATENT DOCUMENTS

| | | | | |
|---|---|---|---|---|
| 4,561,123 | A | 12/1985 | Hull | |
| 5,732,412 | A | 3/1998 | Holden | |
| 6,070,267 | A | 6/2000 | McKewin | |
| 6,347,403 | B1 * | 2/2002 | Wilcox | A41D 13/0556 2/23 |
| 6,421,839 | B1 | 7/2002 | Vo | |
| 6,704,938 | B2 * | 3/2004 | Crockett | A41D 13/065 2/23 |
| 6,988,281 | B1 * | 1/2006 | Jerome | A41D 13/065 2/24 |
| 7,194,770 | B1 | 3/2007 | Fecenko | |
| 7,380,283 | B1 | 6/2008 | Dumont | |
| 7,490,360 | B2 | 2/2009 | Meadows | |
| 7,950,067 | B2 | 5/2011 | Williams | |
| 9,144,253 | B1 * | 9/2015 | Munter | A41D 13/065 |
| 9,167,856 | B1 * | 10/2015 | Pacific | A41D 13/065 |
| 2007/0050877 | A1 | 3/2007 | Rampersad | |
| 2007/0150993 | A1 * | 7/2007 | Oh | A41D 13/0556 2/24 |
| 2010/0235960 | A1 * | 9/2010 | Johnson | A41D 13/065 2/23 |
| 2013/0061365 | A1 * | 3/2013 | Arceo | A41D 13/065 2/24 |
| 2014/0237696 | A1 * | 8/2014 | Carver | A41D 13/0575 2/24 |

* cited by examiner

PANTLEG HOLDING MECHANISM FOR KNEE PADS

RELATED APPLICATION

This application is a continuation-in-part application of application Ser. No. 13/781,333 filed Feb. 28, 2013, the entire disclosure of which is incorporated herein by reference.

BACKGROUND OF THE INVENTION

The present invention relates generally to clothing and, more particularly, to a pantleg holding mechanism for securing a knee pad to a pantleg or other portion of a garment.

Construction workers, mechanics, repairmen, plumbers, electricians, cleaning staff and other types of workers participate in a substantial amount of physical labor due to the nature of their respective jobs and much of this work requires the worker to spend a substantial amount of time on their knees. Crouching on one's knees is a common practice in such fields due to the nature of specific jobs and because such a position provides workers with access to a particular job location or to various things which require their attention but are difficult to reach in an upright or seated position. Frequently applying pressure to one's knees in this manner oftentimes results in chronic pain and/or permanent knee injury. To alleviate this type of pressure on one's knees, laborers often wear knee pads during the course of their work to provide comfort and support to the knees, while still allowing them to kneel as necessary.

A variety of knee pads have been designed in an attempt to provide such cushioning and support to a person's knees with varying degrees of success. Oftentimes knee pads fail to stay properly positioned directly over the knees, frequently moving around or sliding down the worker's leg as the wearer moves or shifts on their knees from one location to another during the course of their work. Thus, it would be desirable to develop a knee pad holding mechanism for positioning and securing a knee pad in such a way that provides adjustability to the user and movement of the knee pad is minimized during use.

SUMMARY OF THE INVENTION

The present invention is directed to a further embodiment of a knee pad holding mechanism which is specifically designed for locating and securing a knee pad in a proper, fixed position to a pantleg, and which provides adjustability to the user to properly place the knee pad directly over the knee area or specifically where the user desires the knee pad to be placed. Specifically, the present mechanism is designed for individuals who are required to spend a great deal of time on their knees. This has application in the trade and laborer industry as well as in certain military applications. The present mechanism is constructed so that a knee pad may be removably attached to a pantleg in a fixed stable position. The present mechanism includes a first length of fabric material and a second length of fabric material which are secured to the pantleg in a spaced opposed relationship to each other adjacent the opposite sides of the knee area, each length of material forming a plurality of loops for receiving and holding at least one fastening strap associated with a knee pad. The loops allow a user to adjust the vertical location of the knee pad relative to the user's knee. Once the straps associated with a knee pad are threaded through the respective opposed pairs of loops, the knee pad is secured in a fixed stable position on the pantleg.

The present pad holding mechanism may also be utilized in other areas or regions of a particular garment such as over the elbow region of a shirt sleeve or other garment for receiving and holding an elbow pad in a fixed stable position on the garment.

Specific advantages and features of the present assembly will be apparent from the accompanying drawings and the description of several illustrative embodiments of the present invention.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
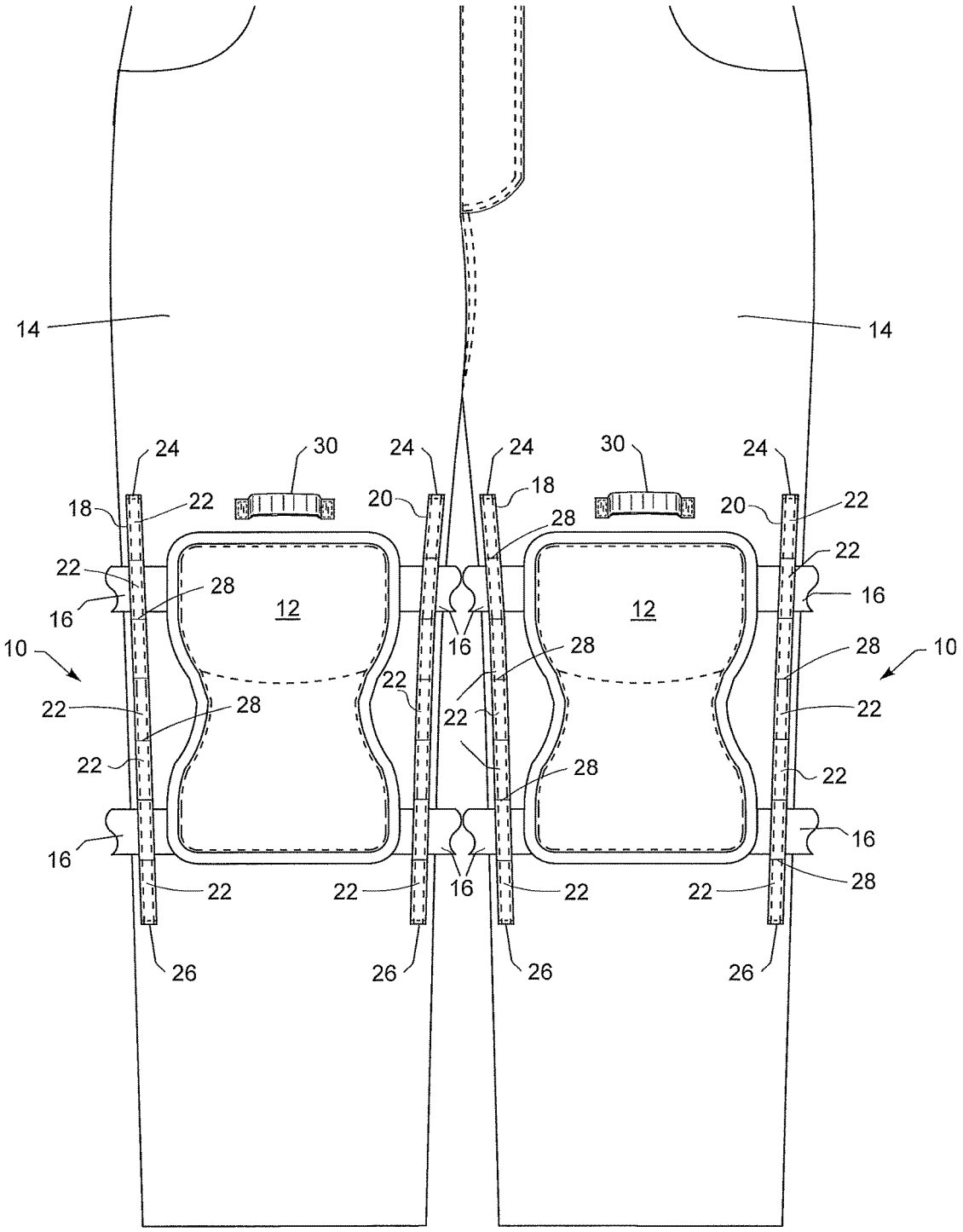
FIG. 1 is a front elevational view of one embodiment of a pantleg knee pad holding mechanism constructed in accordance with the teachings of the present invention showing a pair of knee pads positioned on the present mechanism on the wearer's legs.

Referring now to the drawings more particularly by reference numbers, FIG. 1 illustrates one embodiment of a knee pad holding mechanism 10 which is designed for securing a knee pad 12 to a pantleg 14 and providing user adjustability for positioning it substantially over the knee region of the garment, the present mechanism 10 minimizing movement of the knee pad 12 while the wearer moves during the course of his/her work activities as will be hereinafter further explained. The mechanism 10 is designed for individuals who are required to spend a great deal of time on their knees due to the nature of their trade and is constructed such that the knee pad 12 may he removably and adjustably attached to a pantleg 14 as needed. The mechanism 10 cooperates with the fastening straps 16 associated with the knee pad 12 to properly position the knee pad 12 relative to the pantleg 14. In this regard, the knee region of the pantleg is defined as having a length, opposite sides, top and bottom portions, and being configured to extend along the entire length of a user's knee when the panileg is worn as best illustrated in FIG. 1. The knee region of the pantleg also extends between the fastening straps 16 of the knee pad 12 when the knee pad is placed over a user's knee and over the knee region of the pantleg. A user's knee also has a length. opposite sides, and top and bottom portions. Although the present mechanisms will be described in connection with one embodiment of a typical knee pad 12, it is likewise well-suited for user with essentially any type of knee pad construction as well as with elbow pads as will be further explained.

Figure 2:
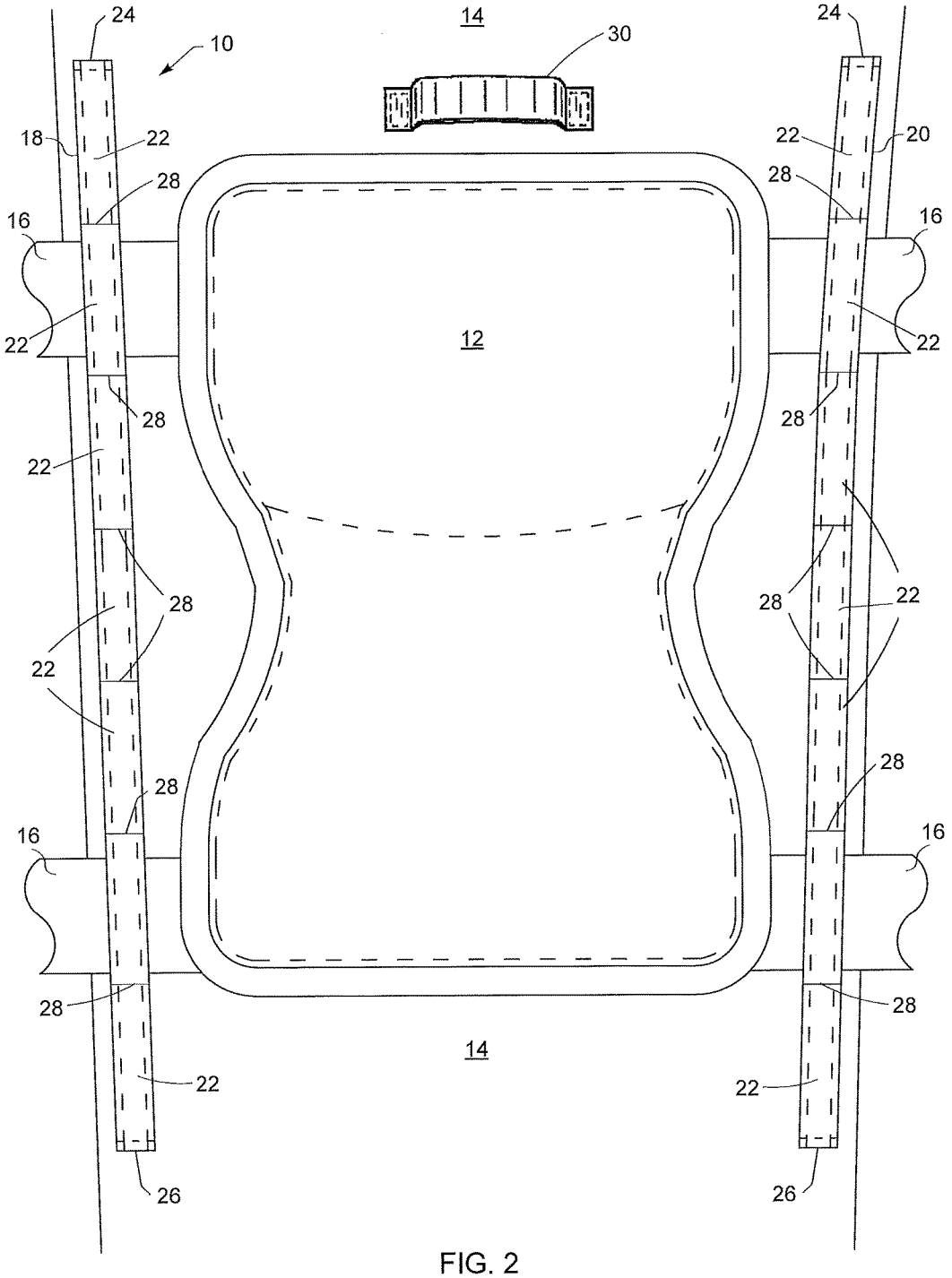
FIG. 2 is an enlarged partial exploded front elevational view of the present mechanism of FIG. 1 showing a knee pad positioned on a wearer's leg using the present mechanism.
Figure 5:
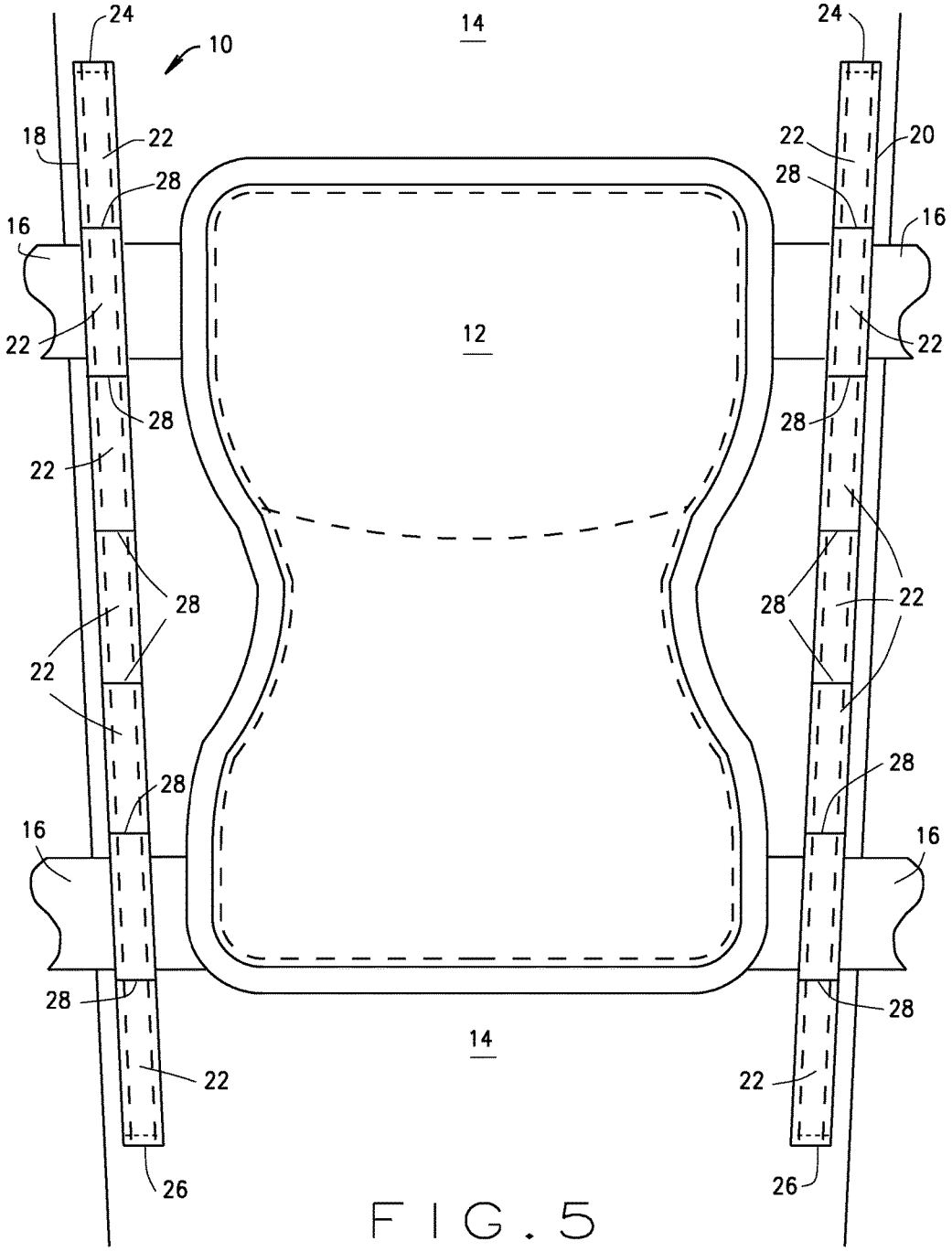

FIG. 5 is an enlarged partial exploded front devotional view of the present mechanism of FIG. 2 without the optional loop member 30.

As illustrated in FIGS. 1 and 2, the mechanism 10 includes a first length of fabric, cord or other material 18 and a second length of fabric, cord or other material 20, the first length of material 18 being secured to the pantleg 14 adjacent one side of the knee area and the second length of material 20 being secured to the same pantleg adjacent the opposite side of the knee area. The first and second lengths of material 18 and 20 are attached to the pantleg 14 so as to form a plurality of loops 22 in a single vertically aligned row as illustrated in FIGS. 1 and 2. The loops 22 are of sufficient length to create an area for a fastening strap 16 associated with a knee pad 12 to be threaded therethrough. In the particular embodiment illustrated, the loops 22 are associated with a single cord, fabric or other material which extends at least along substantially the full length of the knee area on both opposite sides thereof. The single cord or material 18 and 20 form the loops 22 in a single vertically aligned row with each loop 22 positioned and located directly adjacent each other in abutting relationship to each other as illustrated in FIGS. 1 and 2. The first and second lengths of material 18 and 20 may be attached or secured to the pantleg 14 using any suitable attachment means including, but not limited to, stitching, adhesives, glue, welt, fusion bonding, direct attachment constructions and the like. The first and second lengths of material 18 and 20 may also extend both above and below the knee area any distance to allow for attachment of other pad devices depending upon the particular application.

The plurality of loops 22 are formed by attaching or securing the lengths of material 18 and 20 at their respective opposite end portions 24 and 26 and at their respective intermediate portions 28. The loops 22 associated with the first and second lengths of material 18 and 20 are positioned and located in opposed parallel relationship to each other along each opposite side of the knee area in a single vertically aligned row as illustrated in FIGS. 1 and 2 so that the straps 16 associated with the knee pad 12 can be fed through a pair of opposed loops 22 for fastening the straps to the back portion of a person's leg. In this regard, the plurality of opposed loops 22 are positioned and located so as to allow a user to adjust the particular vertical location of a knee pad relative to a wearer's knee. Using one pair of loops 22 on each of the first and second materials 18 and 20 will position a knee pad in one particular location relative to a person's knee, and using a different pair of loops on each of the first and second materials 18 and 20 will position a knee pad 12 in a different position relative to a person's knee. Changing the respective pairs of loops 22 for threading the straps 16 therethrough moves the knee pad 12 up or down vertically relative to a person's knee and provides the adjustability feature to the present embodiment. Threading the straps 16 through a corresponding pair of loops 22 both above and below the knee area fixedly secures the knee pad 12 to the pantleg 14 and prevents the same from moving on shifting vertically during use.

Still further, the first length of fabric material 18 and the second length of fabric material 20 may be formed from the same material as the pantleg 14 such that pants which include the mechanism 10 may be aesthetically pleasing to the wearer, with or without the knee pad 12 positioned thereon.

In use, the knee pad 12 may be positioned on top of the pantleg 14 over the knee area as illustrated in FIGS. 1 and 2 with each of the fastening straps 16 threaded through the corresponding loops or eyelets 22. By threading the straps 16 associated with a knee pad 12 under the loops 22 prevents the knee pad 12 from moving or shifting vertically during use. A user will select the appropriate pair of opposed loops 22 based upon the size of the knee pad 12 and the positioning and location of the fastening straps 16 as well as where the user wants to position the knee pad relative to that user's knee. It is recognized that the upper fastening strap 16 associated with the typical knee pad may be fed through a pair of loops 22, while the lower fastening strap 16 may be fed through another corresponding pair of opposed loops 22. The positioning and location of the plurality of opposed pairs of loops 22 allows a user to adjust the position and location of a particular knee pad relative to that person's knee. This arrangement provides more flexibility and more adjustable options to the intended user depending both upon the particular style, shape and dimensions associated with a typical knee pad 12 and the fastening straps 16 associated therewith, as well as positioning such knee pad in relationship to a user's knee.

The cord, fabric or other material 18 and 20 may be formed from any type of material which is strong enough to support the structure of one or a pair of fastening straps 16 when they are positioned through the loops 22 and which is strong enough to survive the normal wear and tear of the strap engaging and moving across the loops 22 when the straps 16 are engaged therewith.

Figure 3:
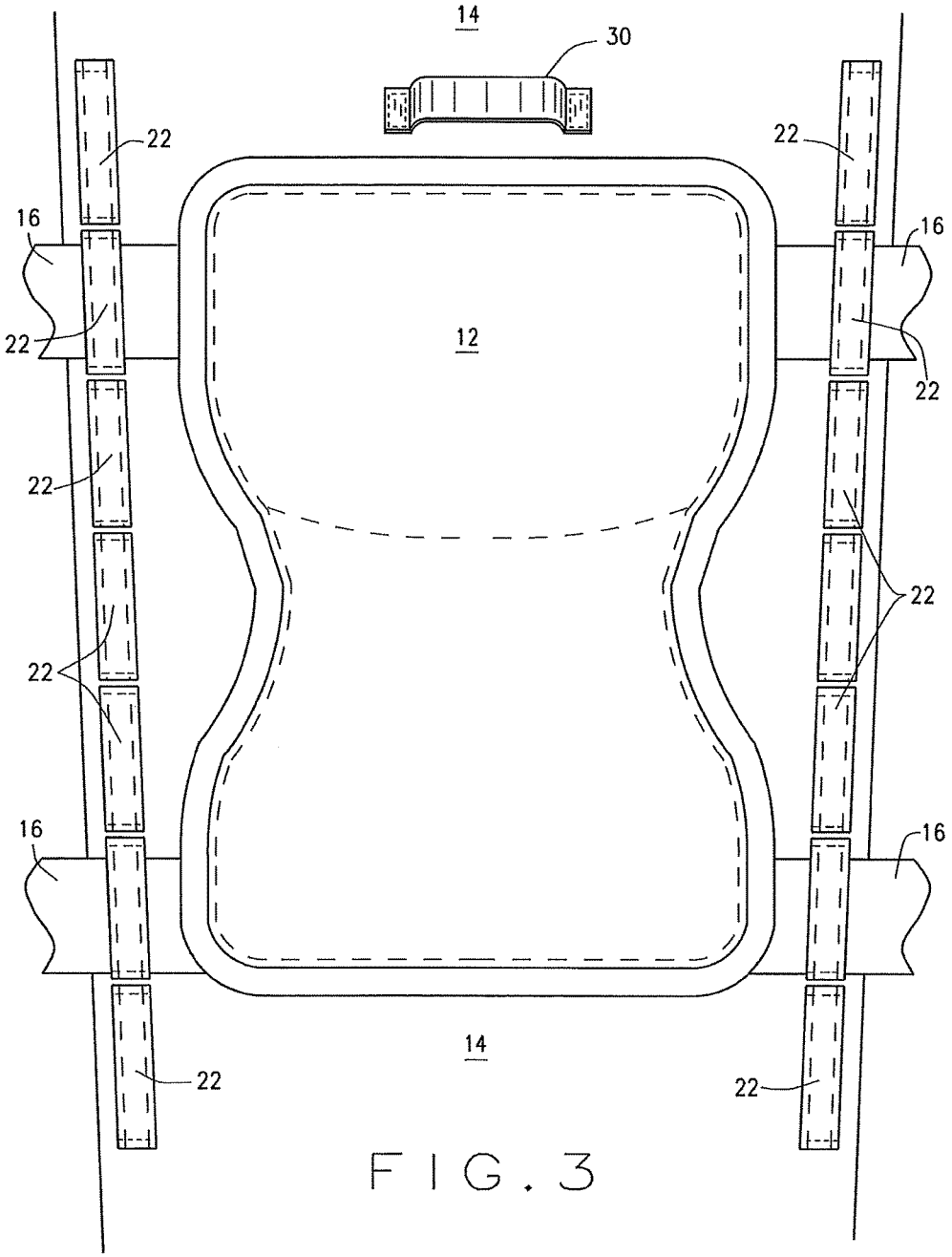
FIG. 3 is an enlarged partial exploded front elevational view of the present mechanism illustrating each loop being individually formed and attached separately on opposite sides of the knee region of a pantleg.
Figure 4:
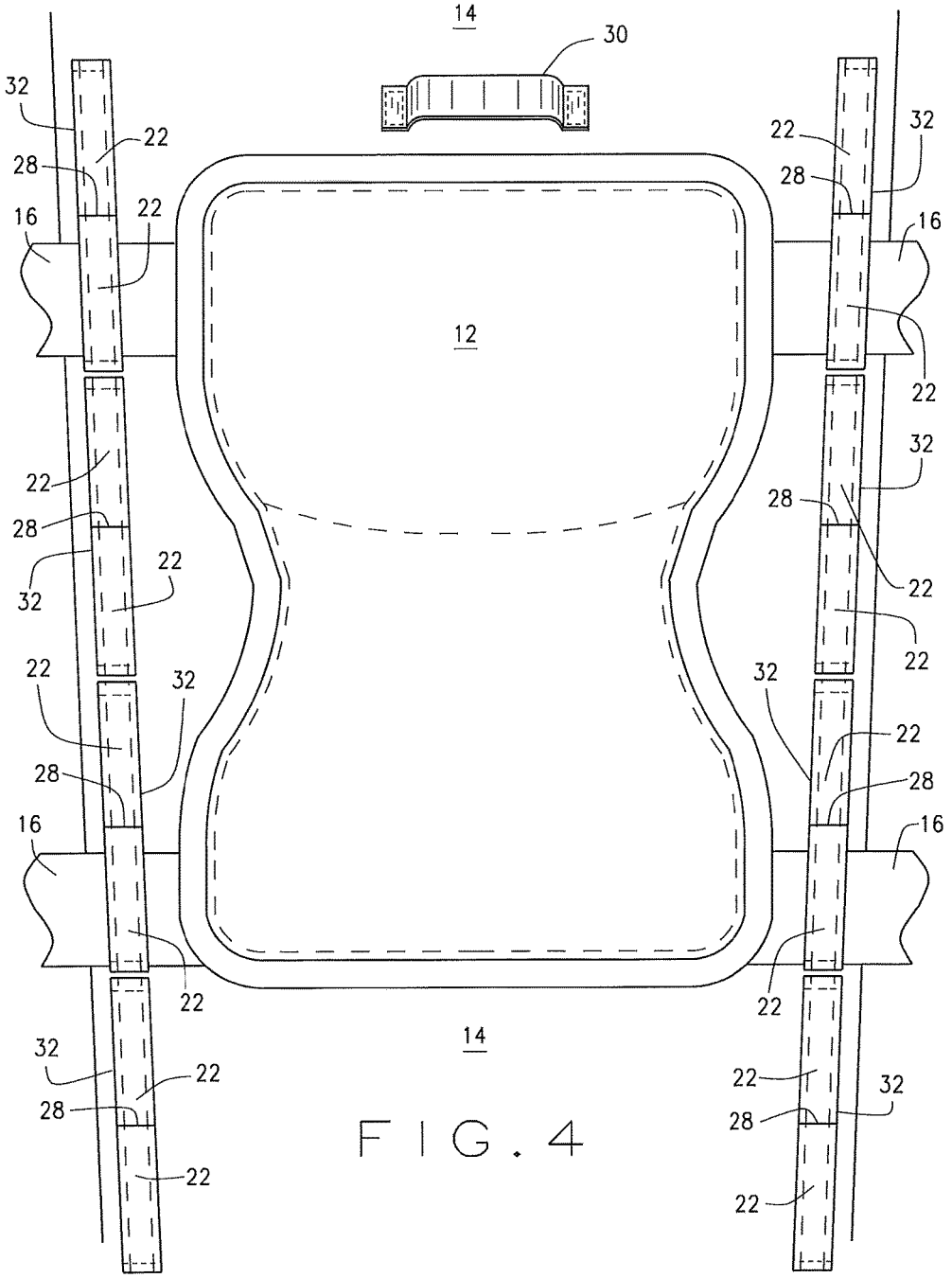
FIG. 4 is an enlarged partial exploded front elevational view of the present mechanism illustrating the loops being formed using a plurality of individual sections or lengths of material, each length of material being formed into at least two loops.

It is also recognized and anticipated that the loops 22 can be formed individually or in groups as compared to using a single cord, fabric or other material which extends substantially the full length of the knee area. In this regard, each individual loop 22 can be respectively attached to pantleg 14 so as to form a single vertically aligned row of loops 22 positioned in spaced apart parallel relationship to each other as illustrated in FIG. 3. In this regard, each loop 22 is individually attached or connected at their respective opposite end portions to pantleg 14 on each opposite side of the knee region. As previously indicated, each loop 22 can be formed from a cord, fabric or other material. In addition, the single cord, fabric or other material 18 and 20 can likewise be formed in any number of a plurality of sections to achieve the stated objective as best illustrated in FIG. 4. In this regard, the loops 22 are formed using a plurality of individual lengths of material 32 which are attached or connected at their respective opposite end portions and at their respective intermediate portions 28 to the pantleg 14 on each opposite side of the knee region, each individual length of material 32 being formed into at least two (2) loops. The individual lengths of material 32 are positioned in a single vertically aligned row on each opposite side of the knee region as illustrated in FIG. 4 with the first and second plurality of individual lengths of material 32 being in parallel relationship to each other. Any arrangement for forming the plurality of loops 22 is contemplated and envisioned.

The fastening strap 16 associated with a typical knee pad 12 can be fed through a pair of opposed loops 22, one pair or two pair, for fastening the straps to the back portion of a person's leg as previously explained so as to allow the user some adjustability of the knee pad 12 relative to the person's knee. In this regard, as previously explained, the loops 22 are positioned and located on the mechanism 10 so as to receive the straps associated with a typical knee pad such as the knee pad 12.

As illustrated in FIGS. 1 and 2, the present mechanism 10 may further optionally include an additional loop or support member 30 which is secured to an upper portion of the pantleg 14 by using any reasonable attachment mechanism. The loop 30 is designed for receiving an additional strap or fastening device 16 which may be secured to the top portion of a typical knee pad (not shown). The loop 30 serves to provide additional positioning and security for the knee pad when this additional knee pad strap is further secured to the loop 30 thereby further preventing the knee pad 12 from moving or slipping downward in the vertical direction.

FIG. 5 illustrates the mechanism 10 of FIG. 2 without the optional loop or support member 30 which can be secured to an upper portion, of the pantleg 14 as shown in FIGS. 2-4. It is recognized that the present mechanism can consist of all of the elements disclosed in FIG. 2 except for the additional loop 30.

It is also recognized and anticipated that the present mechanism 10 can be utilized with any particular garment and can be used to hold a pad over any particular region of that garment. For example, the present mechanism 10 can be easily used in the elbow region of a particular garment for receiving and holding an elbow pad.

Thus, there has been shown and described a novel pad holding mechanism. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A knee pad holding mechanism configured for holding a knee pad over a user's knee in a knee region of a pantleg, the knee pad having at least two spaced apart vertically oriented straps configured for wrapping around the user's knee in the knee region of the pantleg, the knee pad being configured to be placed over the knee region of the pantleg, the mechanism consisting of:

a first single length of material having a length, opposite end portions and intermediate portions, said first single length of material being attached directly to the pantleg adjacent one side of the knee region of the pantleg;

a second single length of material having a length, opposite end portions and intermediate portions, said second single length of material being attached directly to the pantleg, adjacent the other side of the knee region of the pantleg;

said first single length of material being attached to the pantleg at the opposite end portions and at a plurality of intermediate portions of the first single length of material so as to form a first plurality of directly adjacent loops positioned in abutting relationship to each other in a single vertically aligned row and said second single length of material being attached to the pantleg at the opposite end portions and at a plurality of intermediate portions of the second single length of material so as to form a second plurality of directly adjacent loops positioned in abutting relationship to each other in a single vertically aligned row, each of said first and second plurality of loops being sized and shaped to receive a strap associated with the knee pad, said first plurality of loops positioned and arranged in opposed parallel relationship to said second plurality of loops and each of said first and second single length of material extending along a length of the knee region of the pantleg on both opposite sides thereof and extending both above and below a top and a bottom portion of the knee region of the pantleg such that the at least two spaced apart vertically oriented straps associated with the knee pad are each threaded through a respective loop associated with the first and second single length of material both above and below the knee region in parallel relationship to each other;

the length of each of said first and second length of material providing adjustability of the knee pad relative to the knee region of the pantleg.

* * * * *